US012038218B2

(12) United States Patent
Woodling et al.

(10) Patent No.: US 12,038,218 B2
(45) Date of Patent: Jul. 16, 2024

(54) METHOD AND APPARATUS FOR ARTICULATING FEET OF A FREEZER DOOR

(71) Applicant: Midea Group Co., Ltd., Foshan (CN)

(72) Inventors: Pierce Woodling, Louisville, KY (US); Vinayak Naik, Louisville, KY (US); Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/825,768

(22) Filed: May 26, 2022

(65) Prior Publication Data

US 2023/0384015 A1 Nov. 30, 2023

(51) Int. Cl.

| | |
|---|---|
| ***F25D 11/02*** | (2006.01) |
| ***A47B 46/00*** | (2006.01) |
| ***F25D 23/02*** | (2006.01) |

(52) U.S. Cl.

CPC ..... *F25D 11/02* (2013.01); *A47B 46/005* (2013.01); *F25D 23/028* (2013.01)

(58) Field of Classification Search

CPC ..... F25D 11/02; F25D 23/02; F25D 23/028; F25D 2323/02; A47B 46/00; A47B 46/005; A47B 96/00; E05F 7/06; E05F 11/14; E05F 11/54

See application file for complete search history.

(56) References Cited

U.S. PATENT DOCUMENTS

| | | | | |
|---|---|---|---|---|
| 344,521 | A | 6/1886 | Culver | |
| 1,091,393 | A * | 3/1914 | Schulde | F25D 3/04 126/339 |
| 1,533,831 | A | 4/1925 | Colchin | |
| 1,782,523 | A * | 11/1930 | Warren | A47F 3/0482 312/317.2 |
| 2,015,775 | A * | 10/1935 | Abraham | F25D 23/02 219/408 |
| 2,460,681 | A * | 2/1949 | Davis | A47B 46/005 312/304 |
| 3,322,480 | A * | 5/1967 | Barnstead | A47L 15/4261 134/115 R |

(Continued)

FOREIGN PATENT DOCUMENTS

| | | | |
|---|---|---|---|
| CN | 102661082 A | * | 9/2012 |
| CN | 102269508 B | | 5/2013 |

(Continued)

OTHER PUBLICATIONS

Neff, N 70 Built-in Oven, Retrieved from: https://www.neff-home.com/uk/productlist/ovens-compact-ovens/ovens/single-ovens/B57CR22N0B#/Tabs=section-manuals/Togglebox=accessories/Togglebox=manuals/Togglebox=accessoriesOthers/, Retrieved on Jun. 2, 2022.

(Continued)

*Primary Examiner* — Hanh V Tran
(74) *Attorney, Agent, or Firm* — Gray Ice Higdon

(57) ABSTRACT

An appliance having at least a freezer compartment. The appliance may include a at least one freezer door accessing the freezer compartment. The freezer door may include one or more articulating feet positionable between a stowed position and a deployed position. The freezer door may include one or more handles. The appliance may include one or more freezer racks.

17 Claims, 7 Drawing Sheets

(56) References Cited

U.S. PATENT DOCUMENTS

| | | | | | |
|---|---|---|---|---|---|
| 3,354,878 | A * | 11/1967 | Balls | F24C 1/16 | 126/275 R |
| 3,393,950 | A * | 7/1968 | Dutcher | A47L 15/427 | 312/317.2 |
| 3,529,881 | A | 9/1970 | Kaldenberg | | |
| 3,738,727 | A * | 6/1973 | Race | A47L 15/4261 | 312/319.2 |
| 3,912,350 | A * | 10/1975 | Gurubatham | A47L 15/427 | 312/317.2 |
| 4,092,973 | A | 6/1978 | Bernazzani | | |
| 4,494,784 | A | 1/1985 | Haynes | | |
| 4,624,511 | A * | 11/1986 | Oehme | A47B 88/944 | 312/273 |
| 4,687,262 | A * | 8/1987 | St. Louis | A47L 15/427 | 312/319.1 |
| 4,779,941 | A * | 10/1988 | Jessop | G06F 1/181 | 312/249.9 |
| 4,836,624 | A | 6/1989 | Schwickrath | | |
| 4,848,312 | A | 7/1989 | Roy | | |
| 5,937,481 | A | 8/1999 | Faringosi | | |
| 6,263,867 | B1 | 7/2001 | Skelton | | |
| 7,628,461 | B2 * | 12/2009 | Carden | F25D 25/04 | 312/402 |
| 8,025,349 | B2 | 9/2011 | Lim et al. | | |
| 8,231,190 | B2 * | 7/2012 | Ertz | F25D 25/025 | 312/402 |
| 8,506,028 | B2 | 8/2013 | Lim et al. | | |
| 9,157,641 | B1 * | 10/2015 | Draper | F24C 15/026 | |
| 9,297,572 | B2 | 3/2016 | Bischoff et al. | | |
| 10,443,286 | B1 | 10/2019 | Cocco | | |
| 10,478,040 | B1 | 11/2019 | Ford, Jr. | | |
| 2008/0223356 | A1 * | 9/2008 | Shenouda | F24C 15/02 | 126/1 R |
| 2009/0151608 | A1 | 6/2009 | Aldred | | |
| 2010/0281911 | A1 * | 11/2010 | Ha | F25D 25/022 | 62/449 |
| 2011/0273070 | A1 * | 11/2011 | Shin | F25D 23/028 | 312/405 |
| 2012/0042670 | A1 * | 2/2012 | Lee | F25D 25/025 | 62/125 |
| 2012/0060544 | A1 * | 3/2012 | Lee | F25D 25/025 | 312/404 |
| 2012/0091874 | A1 * | 4/2012 | Lee | F25D 23/02 | 312/405 |
| 2013/0257238 | A1 * | 10/2013 | Herron | A47B 81/00 | 312/325 |
| 2016/0076289 | A1 * | 3/2016 | Choi | E06B 3/34 | 312/326 |
| 2017/0051542 | A1 | 2/2017 | Reske | | |
| 2017/0350638 | A1 * | 12/2017 | Park | A47B 95/02 | |
| 2018/0132695 | A1 * | 5/2018 | Lagness | A47L 15/4257 | |
| 2018/0163443 | A1 * | 6/2018 | Park | A47L 15/4257 | |
| 2018/0283698 | A1 * | 10/2018 | Lee | F24C 15/02 | |
| 2019/0024965 | A1 * | 1/2019 | Park | E05F 11/54 | |
| 2020/0141627 | A1 * | 5/2020 | Lambert | F25D 11/00 | |
| 2020/0340732 | A1 | 10/2020 | Querfurth et al. | | |
| 2022/0081949 | A1 * | 3/2022 | Scalf | E05B 1/0015 | |

FOREIGN PATENT DOCUMENTS

| | | | | | |
|---|---|---|---|---|---|
| CN | 102445045 | B | 9/2013 | | |
| CN | 102359308 | B | 7/2016 | | |
| CN | 107246184 | A | 10/2017 | | |
| CN | 108020010 | A | 5/2018 | | |
| CN | 109723279 | B | 9/2021 | | |
| CN | 215632336 | U | 1/2022 | | |
| CN | 216668084 | U | 6/2022 | | |
| DE | 8416860 | U1 | 11/1984 | | |
| DE | 10063353 | A1 * | 6/2002 | A47L 15/4261 | |
| DE | 102007041301 | A1 * | 3/2009 | A47L 15/4257 | |
| DE | 102015116016 | A1 | 3/2016 | | |
| DE | 102014223383 | A1 * | 5/2016 | F24C 15/02 | |
| DE | 102015104200 | A1 * | 9/2016 | | |
| EP | 0632180 | A1 | 1/1995 | | |
| EP | 3021047 | A1 * | 5/2016 | E05B 17/0041 | |
| GB | 190016241 | A | 4/1901 | | |
| WO | 2004049865 | A1 | 6/2004 | | |
| WO | 2009027405 | A1 | 3/2009 | | |

OTHER PUBLICATIONS

Draper, Richard James, Oven Door Support Legs, Retrieved from https://forsalebyinventor.com/products/portfolio-item/oven-door-support-legs/, 2014.

Related Applications Transmittal dated Jan. 3, 2023.

Mah, Chuck Y., United States Patent and Trademark Office, Non-Final Office Action issued in U.S. Appl. No. 17/021,165, 134 pages, dated Jun. 16, 2023.

Mah, Chuck Y, United States Patent and Trademark Office, Notice of Allowance issued in U.S. Appl. No. 17/021,165, 20 pages, dated Nov. 3, 2023.

* cited by examiner

METHOD AND APPARATUS FOR ARTICULATING FEET OF A FREEZER DOOR

BACKGROUND

The present embodiments relate to a method and apparatus for articulating one or more feet of a freezer door integrated into an appliance.

Typical appliance doors (e.g. dishwasher or range) may hinge from an appliance but are unable to support heavy loads placed thereon. Thus, there is a need to support a freezer door when opened that may be subjected to one or more heavy loads of frozen goods/products via one or more baskets/racks.

SUMMARY

In some embodiments of the invention, for example, an appliance having a freezer compartment may include a housing having the freezer compartment and defining an opening into the freezer compartment. In various embodiments, the appliance may include a freezer door hingedly attached adjacent the opening into the freezer compartment to the housing. In some embodiments, the freezer door may be positionable between a closed position and an open position relative to the opening into the freezer compartment. In some embodiments, the appliance may include one or more feet positionable between a stowed position within the door when the door is in the closed position and a deployed position extending out of the door when the door is in the open position.

In some embodiments, the appliance may include a handle positioned with the freezer door. In various embodiments, the handle may actuate the one or more feet between the stowed position and the deployed position. In some embodiments, the handle may pivot relative to the freezer door. In various embodiments, the appliance may include an articulating assembly between the one or more feet and the freezer door. In some embodiments, the articulating assembly may include a rack and pinion engagement between the one or more feet and the freezer door. In addition, in various embodiments, the freezer door may include a handle pivotably connected to the freezer door, and wherein the handle actuates the rack and pinion engagement between the one or more feet and the freezer door.

In various embodiments, a freezer door may be hingedly attached to an appliance and positionable between a closed position and an open position. In some embodiments, the freezer door may include one or more feet positionable between a stowed position within the door when the door is in the closed position and a deployed position extending out of the door when the door is in the open position. In various embodiments, the freezer door may include a handle pivotably connected to the freezer door. In some embodiments, the handle may actuate the one or more feet between the stowed position and the deployed position.

In addition, in some embodiments, the freezer door may include an articulating assembly between the one or more feet and the handle. In various embodiments, the articulating assembly may include one or more rack and pinion engagements, wherein the one or more rack and pinion engagements may include at least one rack and at least one pinion. In various embodiments, the one or more feet may include at least one rack and the handle may include at least one pinion. In some embodiments, at least one pinion and the handle may pivot about a hinge axis relative to the freezer door. In various embodiments, the one or more feet may linearly translate relative to the freezer door between the stowed position and the deployed position. In some embodiments, the freezer door may be a bottom freezer door. In various embodiments, the freezer may include a top edge and opposing bottom edge, wherein the bottom edge is adjacent a hinge configured to engage the appliance, and wherein the one or more feet are positioned adjacent the top edge of the freezer door. In some embodiments, the freezer door may include a front surface interconnecting the top edge to the bottom edge, and wherein the one or more feet is in the stowed position within the front surface of the freezer door and when in the deployed position the one or more feet extend out of the front surface of the freezer door.

In various embodiments, a method of articulating one or more feet of a freezer door may include providing a housing having a freezer compartment defining an opening into the freezer compartment and a freezer door hingedly attached adjacent the opening into the freezer compartment to the housing. In some embodiments, the freezer door may be positionable between a closed position and an open position relative to the opening into the freezer compartment. In various embodiments, the freezer door may include one or more feet positionable between a stowed position and a deployed position. In some embodiments, the method may include pivoting the freezer door to the open position relative to the opening into the freezer compartment. In various embodiments, the method may include deploying the one or more feet from the stowed position to the deployed position.

In addition, in some embodiments, the freezer door may include a handle, and further comprising the step of actuating the handle to deploy the one or more feet from the stowed position to the deployed position. In various embodiments, the method of actuating the handle includes the step of pivoting the handle relative to the freezer door. In some embodiments, the method may include stowing the one or more feet from the deployed position to the stowed position. In various embodiments, the freezer door may include a handle, and further comprising the step of actuating the handle to stow the one or more feet from the deployed position to the stowed position. In some embodiments, the method may include deploying a freezer rack onto the freezer door from the freezer compartment when the freezer door is in the open position.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
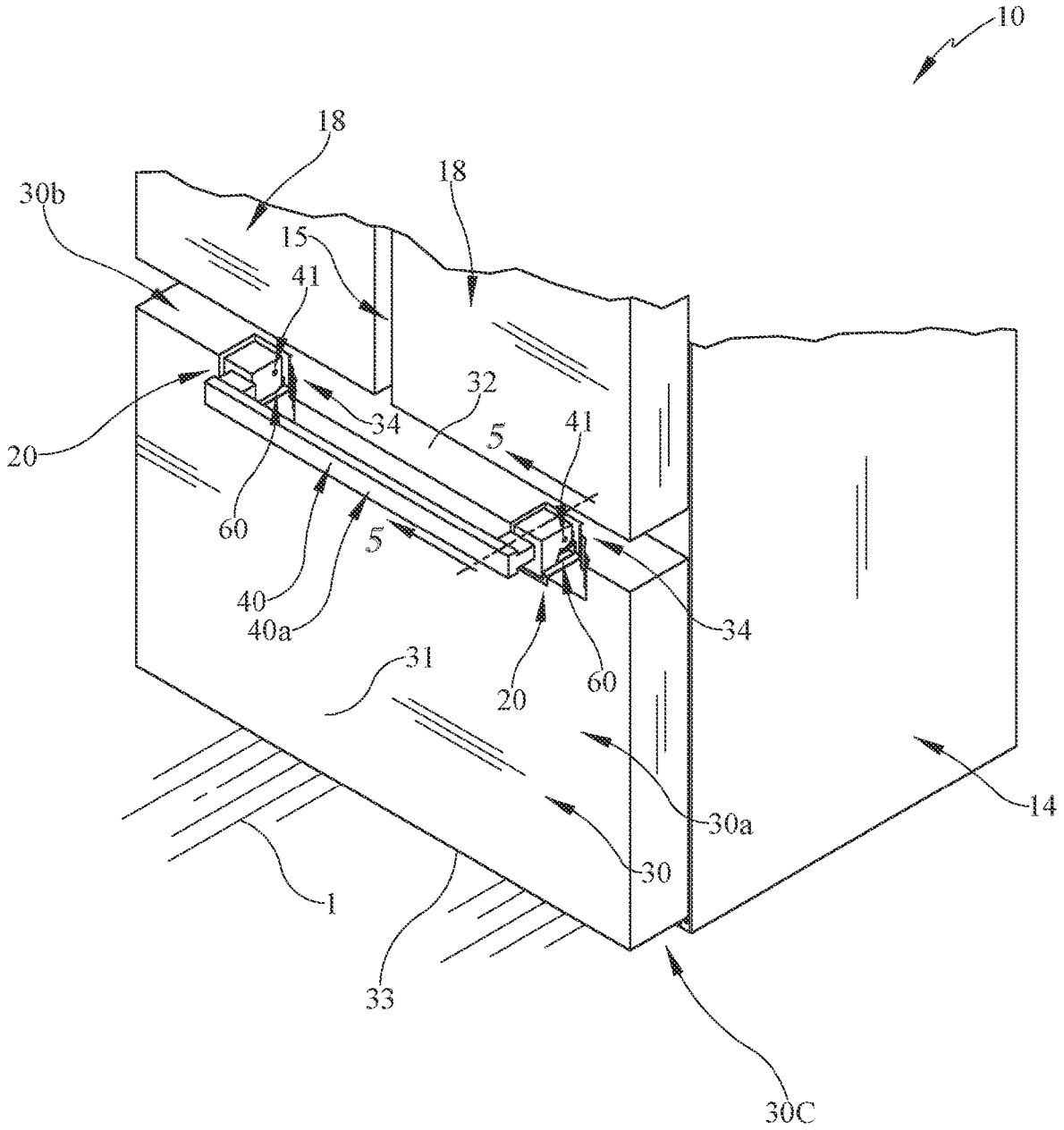
FIG. 1 is a perspective view of one embodiment of an appliance, with portions of the appliance broken away, having at least a freezer compartment/door illustrating a handle in a first position and an embodiment of one or more feet in a stowed position.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential refrigerator appliance such as refrigerator appliance 10, such as the type that may be used in single-family or multi-family dwellings, or in other similar applications. However, it will be appreciated that the herein-described techniques and apparatuses may also be used in connection with other types of refrigerator/freezer appliances in some embodiments. For example, the herein-described techniques may be used in commercial applications in some embodiments. Moreover, the herein-described techniques may be used in connection with various refrigerator appliance configurations. Implementation of the herein-described techniques within refrigerators, freezers, bottom freezer refrigerators, compact refrigerators/freezers, chest freezers, standing freezers, side by side refrigerator, etc. using a freezer door (e.g. hinged) would be well within the abilities of one of ordinary skill in the art having the benefit of the instant disclosure, so the embodiments are not limited to the bottom freezer refrigerator implementation discussed further herein. In some embodiments, the appliance or device utilizing the method and apparatus for articulating one or more feet need not be a refrigerator, or even a freezer.

Turning now to the drawings, the Figures illustrate an example refrigerator appliance 10 in which the various technologies and techniques described herein may be implemented. Refrigerator appliance 10 is depicted in this example as a French door bottom freezer refrigerator, and as such includes a front-mounted bottom freezer door 30 in a cabinet or housing 14 that provides access to the freezer compartment 13 housed within the cabinet or housing 14, and when in the open position (FIG. 2), food and beverage items may be inserted into and removed from the freezer compartment 13 (e.g. freezer basket, bin, and/or rack 16). The housing 14 may define at least a portion of an opening 13*a* into the freezer compartment 13. Similarly, adjacent pivotable French doors 18 may provide access to the fresh-food compartment 15. Freezer door 30 is pivotably/hingedly attached to the housing 14 adjacent the freezer compartment 13 and/or opening 13*a*. The freezer door 30 may be a bottom freezer door as shown in the one embodiment. Freezer door 30 may be generally provided with a hinge 17 along a corresponding side or front edge of the housing 14 adjacent the freezer compartment 13 and is pivotable between a closed position (FIGS. 1, 3, and 5) and an open position (FIGS. 2, 4, 6 and 7). The freezer door 30 or door body 30*a* may include a top edge 30*b* and an opposing bottom edge 30*c* adjacent the hinge 17 configured to engage the appliance 10. The freezer door 30 may be hinged or pivot about a horizontal axis. The freezer door 30 or body 30*a* may include a front surface 31 interconnecting the top edge 30*b*/top surface 32 to the bottom edge 30*c*/bottom surface 33. When freezer door 30 is in the open position, food and beverage items may be inserted into and removed from the freezer compartment 13 through the bottom freezer door 30. Moreover, when the freezer door 30 is in the open position, one or more freezer compartment bins, baskets, racks, or shelves 16 may be deployed from the freezer compartment 13 and onto the freezer door 30 to be supported by the door and/or the one or more feet or supports 20.

Figure 2:
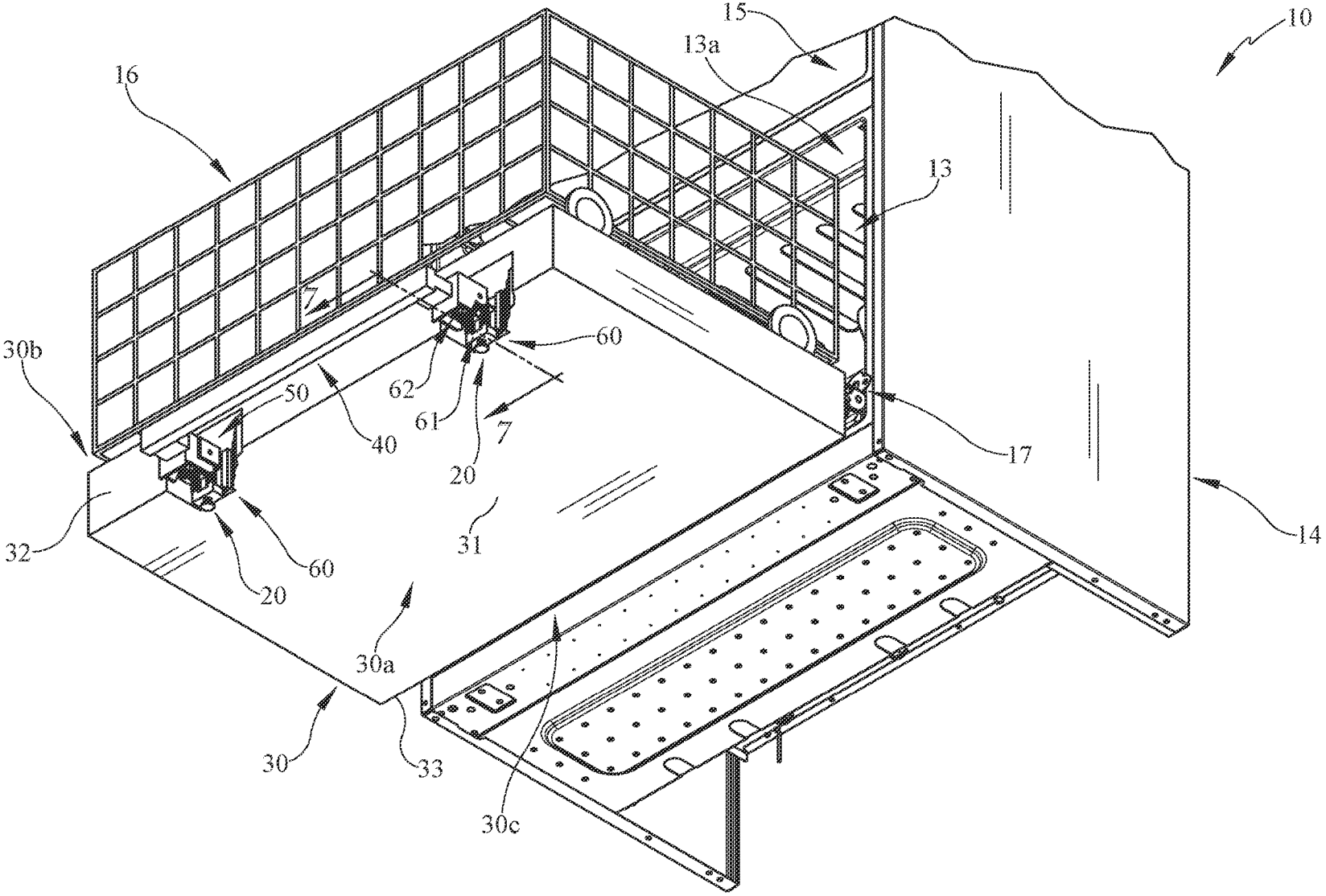
FIG. 2 is a perspective view of one embodiment of an appliance, with portions of the appliance broken away, having at least a freezer compartment/door illustrating the handle in a second position and an embodiment of one or more feet in a deployed position.

As shown in the Figures, at least one freezer door 30 may include one or more feet 20 to support the freezer door 30 and/or freezer rack 16 to the ground/floor 1 when the freezer door 30 is in the open position. The one or more feet 20 (e.g. posts, legs, etc.), or portions thereof, may be positionable between at least one stowed position within the door 30 (e.g. front surface 31, top edge 30*b*, cavity 34) and one or more deployed positions different from the stowed position or extending out or outwardly away from the freezer door 30 (e.g. front surface 31, top edge 30*b*, cavity 34). As shown in FIG. 1, the stowed position of the one or more feet 20, or portions thereof, may be when the door 30 is in the closed position. As shown in FIG. 2, the deployed position of the one or more feet 20, or portions thereof, may be when the door 30 is in the open position. The one or more feet 20 may be adjacent the handle 40, top edge 30*b*, and/or front surface 31 of the freezer door 30. The one or more feet 20 may be deployed from one or more compartments/cavities 34 within the freezer door 30. The one or more cavities 34 may be positioned in the front surface 31, top surface 32, and/or top edge 30*b* of the freezer door 30. The one or more feet 20 may linearly move or translate between the stowed/deployed positions. The feet 20 may move in a variety of directions/paths such as, but is not limited to, an arcuate path. Although a plurality of feet 20 may be positioned separately from each other as shown in the one embodiment, it should be understood that the feet 20 may be combined together. Further, the one or more feet 20 may deploy/stow at the same or different rate and/or at the same/different time. A foot 20 may include a body 20*a* having one or more engagements with the door, or portions thereof. As shown in the one embodiment, the foot body 20*a* may be in a sliding engagement 50 (e.g. rail system, tongue and groove) with the freezer door 30 or body 30*a*, or portions thereof. The one or more feet 20 or feet body 20*a* may be positioned adjacent the top edge 30*b*, front surface 31, and/or handle 40 opposite to the hinge 17 and/or bottom edge 30*c*. In the one embodiment shown in FIG. 4, the one or more feet 20 or feet body 20*a* may include an adjustable portion or pad(s) 21 that may be deployed between one or more lengths. The pad 21 is shown as a shorter length in broken lines and a longer length in solid lines in FIG. 4. The adjustable length of the pad 21 may adjust the one or more feet to contact or extend to uneven surfaces or the ground 1 to level the door when in the open position. Further, a locking nut may be used to secure the pad at one or more lengths. The one or more pads 21 or feet may also have a dampening mechanism (e.g. springs) to provide dampening when heavy loads/forces are applied to the door/feet. The one or more feet 20 may be of a variety of sizes, shapes, quantities, constructions, engagements with the door, or portions thereof (e.g. handle), and different positions within the door and still be within the scope of the invention herein. For example, although the feet 20 are shown adjacent the top edge 30*b* or a distance distal to the hinge the feet 20 may be positioned closer towards the housing 14 or hinge 17 in some embodiments.

Figure 3:
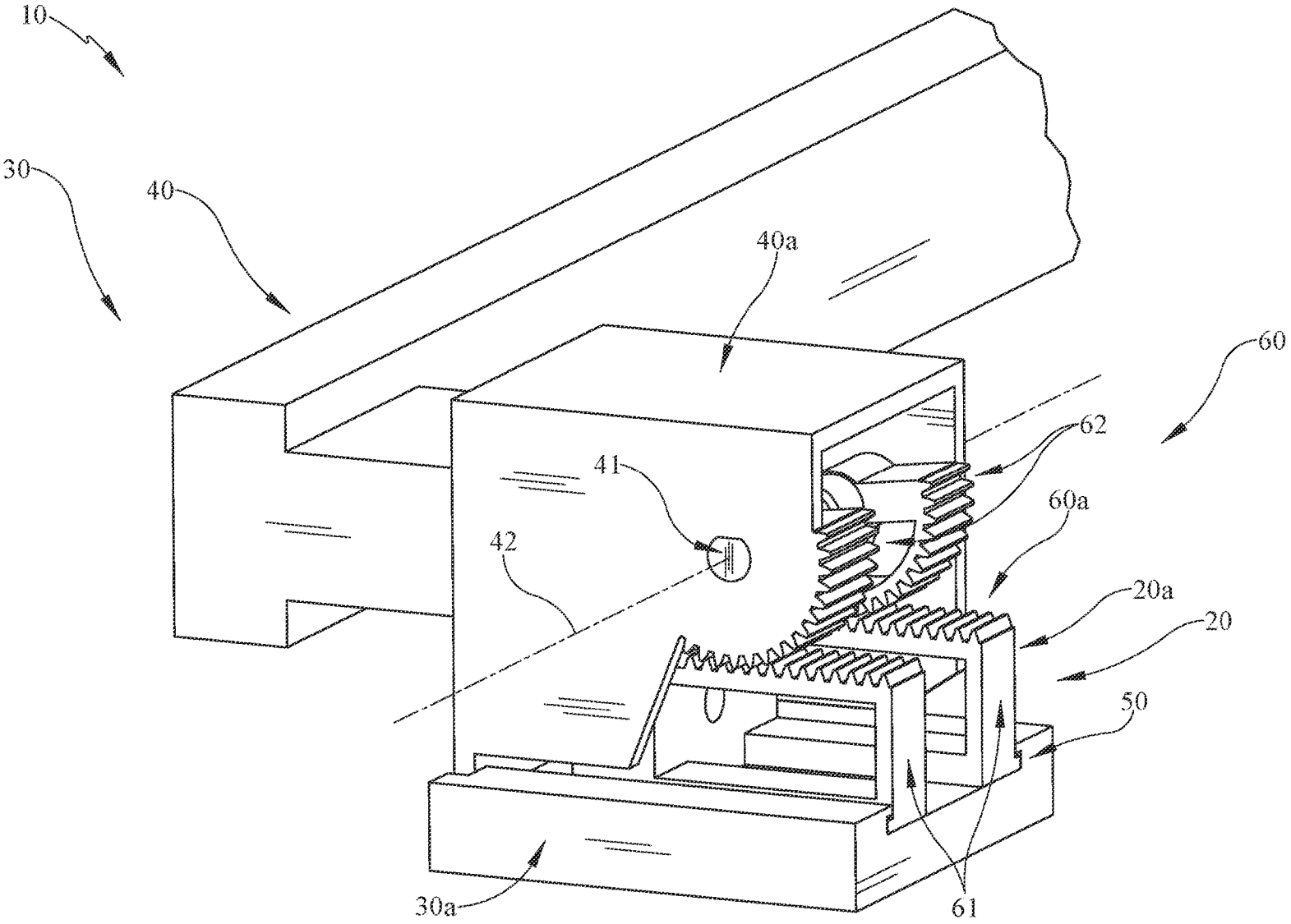
FIG. 3 is an enlarged perspective view of the handle and one or more feet of FIG. 1.
Figure 4:
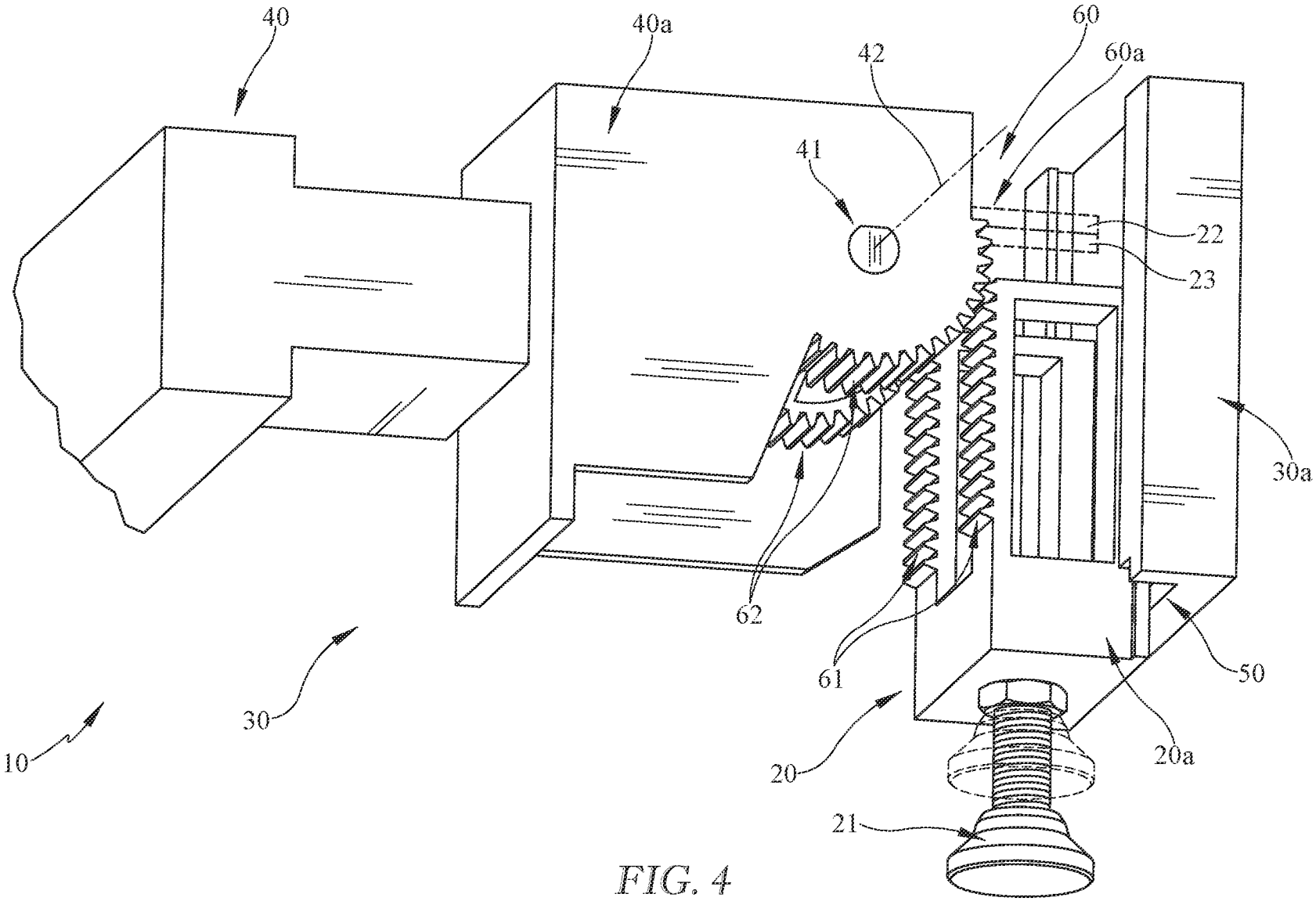
FIG. 4 is an enlarged perspective view of the handle and one or more feet of FIG. 2.
Figure 5:
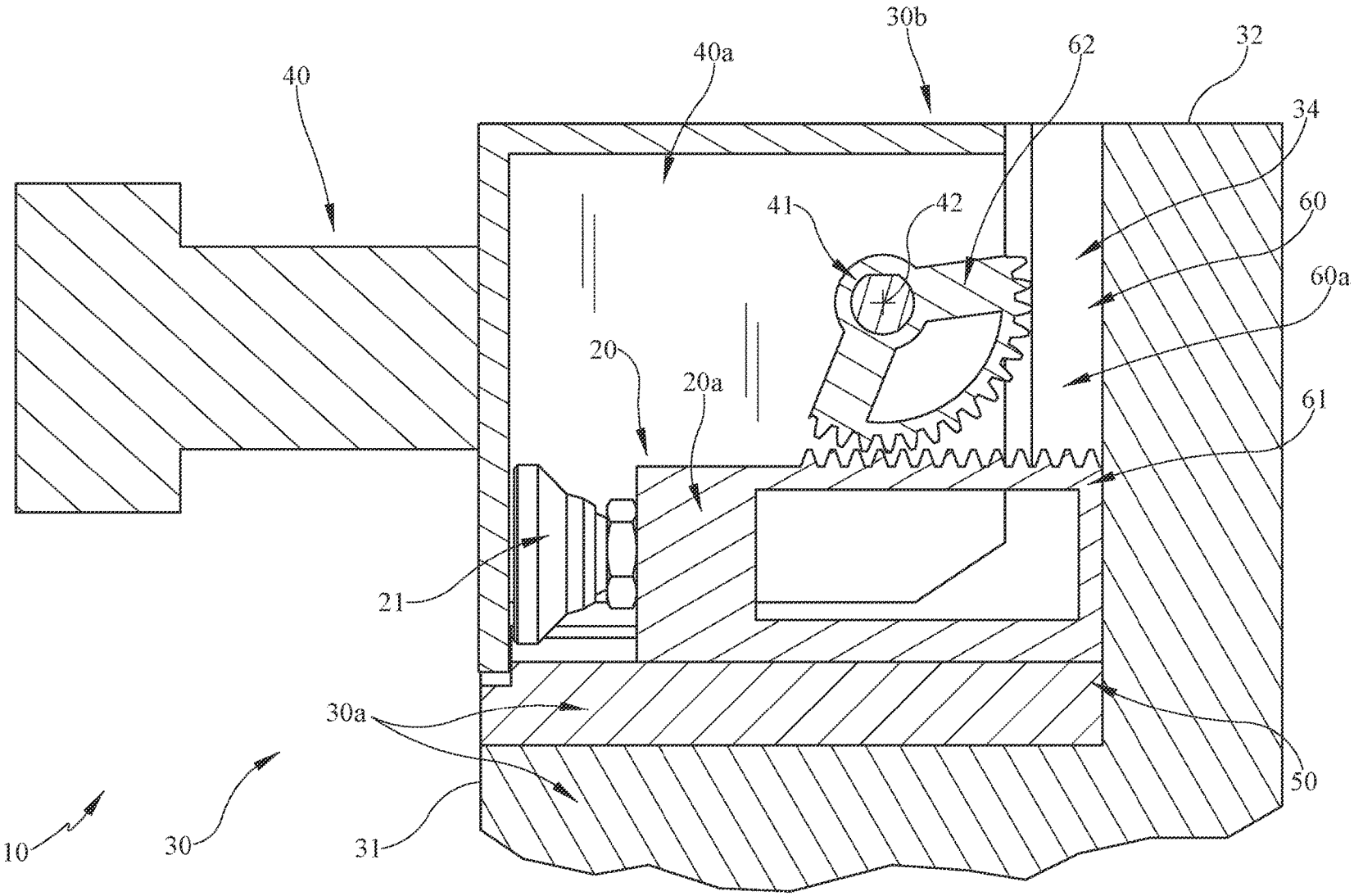
FIG. 5 is a sectional view taken along line 5-5 of FIG. 1 illustrating the handle in the first position.
Figure 6:
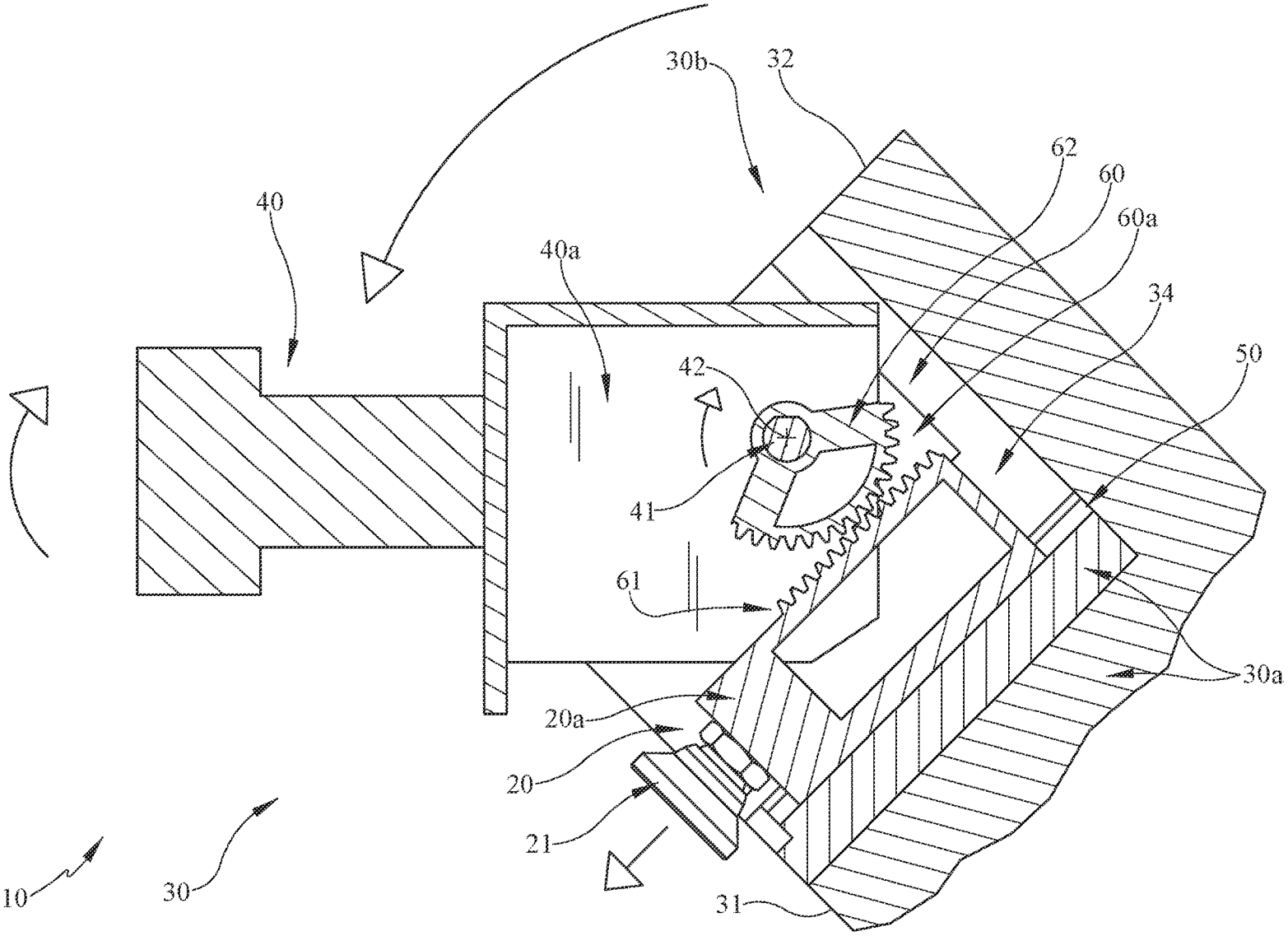
FIG. 6 is a sectional view of FIG. 5 deploying the one or more feet from the stowed position and illustrating the handle pivoting about 45 degrees from the first position.
Figure 7:
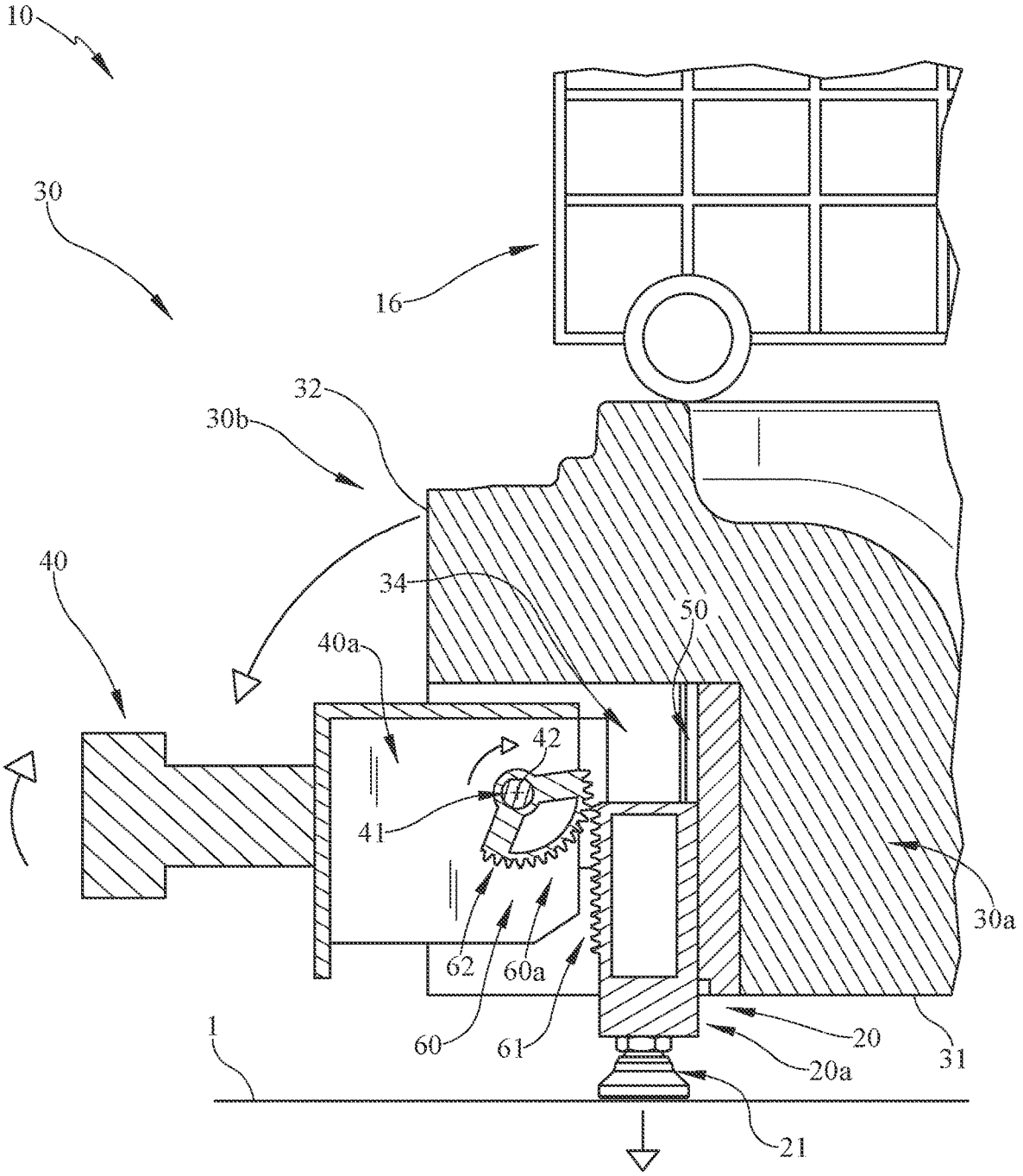
FIG. 7 is a sectional view taken along line 7-7 of FIG. 2 and illustrating the handle pivoting about 90 degrees from the first position to the second position.

In some implementations, one or more handles 40 may be used to actuate the freezer door 30 between one or more positions and/or actuate the one or more feet 20 between one or more positions. The one or more handles 40, if used, may be positioned with the freezer door 30. The handle 40 may be used to position the door between the closed position and the open position. As shown in the one embodiment, the door handle 40 may be used to actuate or drive the one or more feet 20 between the stowed position and the deployed position (e.g. from the stowed position to the deployed position and/or from the deployed position to the stowed position). The handle 40 or body 40*a* may be pivotably connected to the freezer door 30. The handle 40 may pivot between one or more positions (e.g. first pivot position, second pivot position, etc.) when actuating the one or more feet 20 and/or articulating assembly 60. Although the handle 40 may pivot or rotate a variety of angles/degrees about its hinge 41 or first axis 42, the handle 40 may pivot about 90 degrees as shown in FIGS. 5-7 when pivoting relative to the freezer door 30 and/or actuating the one or more feet 20. As shown in FIGS. 1, 3, and 5, when the freezer door 30 is in the closed position and the one or more feet 20 are in the stowed position, the handle 40 may be in a first pivot position extending/projecting from the front surface 31 of the freezer door 30 (e.g. substantially perpendicular to the front surface 31, horizontal to the ground 1). As shown in FIGS. 2, 4, and 7, when the freezer door 30 is in the open position and the one or more feet, or portions thereof, are in the deployed position, the handle 40 may be in a second pivot position extending/projecting from the top surface 32 of the freezer door 30 (e.g. 90 degrees from the first pivot position, substantially perpendicular to the top surface 32, horizontal to the ground 1). The handle 40 may be a variety of shapes, sizes, quantities, positions on the door, and constructions and still be within the scope of the invention herein.

In some implementations, one or more articulating assemblies 60 may be used between the one or more feet 20 and the appliance 10, or portions thereof (e.g. freezer door 30, handle 40) to deploy and/or stow the one or more feet/supports 20. In the one embodiment shown in the Figures, the articulating assembly 60 may be one or more rack and pinion engagements 60*a*. The articulating assembly 60 and/or rack and pinion engagement 60*a* may allow or convert the motion (e.g. rotatory and/or pivoting) of the handle 40 into motion (e.g. linear) of the one or more feet 20 to deploy/stow relative to the remaining portion of the appliance 10 (e.g. freezer door 30). The handle 40 or handle body 40*a* may include at least one pinion 62. The handle body 40*a* may include at least one pinion 62 (e.g. two pinions) on the opposing ends. The feet 20 or feet body 20*a* may include at least one rack 61 (e.g. two racks) corresponding to at least one pinion 62. The pinion 62 may pivot about a hinge axis (e.g. first axis 42, axis different from the handle axis). As shown in the one embodiment, the handle 40 and the one or more pinions 62 may pivot or rotate about the first axis 42 relative to the freezer door 30 or body 30*a*. The pinion 62 may be fixed to the handle body 40*a*. The pinion 62 may be a pair of pinions as shown in the one embodiment spaced away from each other in parallel. Although the pinion 62 is shown as a partial gear (e.g. two gears), the gears may be a bevel gear, spur gear, etc. The feet 20 or feet body 20*a* may include a pair of racks 61 as shown in the one embodiment spaced away from each other in parallel. The feet body 20*a* may include the rack(s) 61 on an opposing side to the sliding engagement 50. The one or more feet 20 and/or rack(s) 61 may translate (e.g. linearly, arcuately) relative to the freezer door 30 (e.g. sliding engagement 50) between the stowed position and the deployed position. It should be understood that the articulating assembly, or portions thereof, may be a variety of shapes, sizes, quantities, constructions, and positions within the appliance/freezer door and still be within the scope of the invention herein. For example, the rack and pinion may disengage from each other during relative movement between each other in some embodiments. Further, for example, the articulating assembly, appliance, feet, and/or freezer door may include one or more biasing elements 22 (e.g. torsion spring) to return the handle to the first position and/or feet to the stowed position. The biasing element may be positioned between the pair of racks and/or pinions (e.g. spaces or channels between one or more pairs) in some embodiments as shown in FIG. 4. Moreover, for example, one or more rotatory dampers 23 may be used to slow the biasing element and/or return of the handle to a position and/or foot to the stowed position. The damper(s) may be positioned between the pair of racks and/or pinions (e.g. spaces or channels between one or more pairs) in some embodiments as shown in FIG. 4. Although the rack is shown as linear, it should be understood that the rack may be a variety of shapes, sizes, quantities, and constructions. For example, the rack may be arcuate in some embodiments. Although one embodiment of the pinion is shown in the Figures, it should be understood that the pinion may be a variety of shapes, sizes, quantities, and constructions. For example, the one or more pinions may be a plurality of gears and/or have a plurality of gear ratios. The articulating assembly, in some embodiments, may include one or more pulleys and/or cam followers.

In use, when the freezer door 30 is in the closed position the freezer compartment 13 may be sealed, the one or more freezer racks 16 may be stowed, the one or more feet 20 may be in the stowed position, and/or the handle 40 may be in the first position (e.g. first pivot position). The user may use the handle 40 to assist in opening the freezer door 30. The freezer door 30 may be pivoted about the hinge 17 to the open position. Upon actuating (e.g. rotating/pivoting) the handle 40 from the first position (e.g. pivot) to the second position (e.g. pivot), the one or more feet 20 move or deploy from the stowed position to the deployed position. The handle, articulating assembly, rack and pinion engagement, or portions thereof may be actuated to stow/deploy the one or more feet 20, or portions thereof relative to the appliance/freezer door. The feet 20 and/or rack 61 may slide or move in engagement (e.g. sliding engagement 50) with the freezer door 30. When in the deployed position, the one or more feet 20 may support the freezer door 30 (e.g. horizontal position) against the ground/floor 1. The feet 20/pad 21 may be adjusted in length by the user to manually adjust (e.g. thread/unthread the pad, lock/unlock) to level the door/feet contact with the uneven floor/ground, if any. This manual adjustment in feet/pad length may be done during installation in some applications. The user may then deploy the one or more freezer racks 16 (e.g. baskets) from the freezer compartment 13 and onto the freezer door 30 (e.g. interior or back side) in its open position. The freezer door 30 and/or one or more feet 20 may support one or more forces applied to the door and/or the weight of the one or more freezer racks/bins/baskets 16 and its contents. Upon placement of the one or more freezer racks 16 to the stowed position within the freezer compartment 13, the freezer door 30 may be closed by the user. Upon actuating (e.g. rotating/pivoting) the handle 40 from the second position (e.g. pivot) to the first position (e.g. pivot), the one or more feet 20 move or stow from the deployed position to the stowed position. The biasing element, if used, may return or assist the user in stowing the one or more feet.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An appliance having a freezer compartment comprising:

a housing having the freezer compartment and defining an opening into the freezer compartment;

a freezer door hingedly attached adjacent the opening into the freezer compartment to the housing, and wherein the freezer door is positionable between a closed position and an open position relative to the opening into the freezer compartment;

one or more feet positionable between a stowed position within the door when the door is in the closed position and a deployed position extending out of the door when the door is in the open position; and a handle positioned with the freezer door, and the handle directly engages the one or more feet to actuate the one or more feet between the stowed position and the deployed position.

2. The appliance of claim 1 wherein the handle pivots relative to the freezer door.

3. The appliance of claim 1 further comprising an articulating assembly between the one or more feet and the freezer door.

4. The appliance of claim 3 wherein the articulating assembly includes a rack and pinion engagement between the one or more feet and the freezer door.

5. The appliance of claim 4 wherein the handle is pivotably connected to the freezer door, and wherein the handle actuates the rack and pinion engagement between the one or more feet and the freezer door to linearly translate the one or more feet relative to the freezer door.

6. A freezer door hingedly attached to an appliance and positionable between a closed position and an open position, the freezer door comprising:

a front surface;

one or more feet positionable between a stowed position within the door when the door is in the closed position and a deployed position extending out of the door when the door is in the open position; and a handle pivotably connected to the freezer door, and wherein the handle directly engages the one or more feet to actuate the one or more feet to linearly translate along a direction out of the front surface of the door between the stowed position and the deployed position that is substantially perpendicular to the front surface.

7. The freezer door of claim 6 further comprising an articulating assembly between the one or more feet and the handle.

8. The freezer door of claim 7 wherein the articulating assembly includes one or more rack and pinion engagements, wherein the one or more rack and pinion engagements include at least one rack and at least one pinion, and the one or more feet includes the at least one rack and the handle includes the at least one pinion.

9. The freezer door of claim 8 wherein the at least one pinion and the handle pivot about a hinge axis relative to the freezer door.

10. The freezer door of claim 6 wherein the freezer door is a bottom freezer door.

11. The freezer door of claim 6 further comprising a top edge and opposing bottom edge, wherein the bottom edge is adjacent a hinge configured to engage the appliance, and wherein the one or more feet are positioned adjacent the top edge of the freezer door.

12. The freezer door of claim 11 further comprising a front surface interconnecting the top edge to the bottom edge, and wherein the one or more feet is in the stowed position within the front surface of the freezer door and when in the deployed position the one or more feet extend out of the front surface of the freezer door.

13. A method of articulating one or more feet of a freezer door comprising the steps of:

providing a housing having a freezer compartment defining an opening into the freezer compartment and the freezer door hingedly attached adjacent the opening into the freezer compartment to the housing, and wherein the freezer door is positionable between a closed position and an open position relative to the opening into the freezer compartment, and wherein the freezer door includes the one or more feet positionable between a stowed position and a deployed position;

providing a handle directly engaging the one or more feet;

pivoting the freezer door to the open position relative to the opening into the freezer compartment; and actuating the handle to deploy the one or more feet from the stowed position to the deployed position.

14. The method of claim 13 wherein actuating the handle includes the step of pivoting the handle relative to the freezer door.

15. The method of claim 13 further comprising the step of stowing the one or more feet from the deployed position to the stowed position.

16. The method of claim 13 further comprising the step of actuating the handle to stow the one or more feet from the deployed position to the stowed position.

17. The method of claim 13 further comprising the step of deploying a freezer rack onto the freezer door from the freezer compartment when the freezer door is in the open position.

* * * * *